US010281094B2

(12) United States Patent
Liu

(10) Patent No.: US 10,281,094 B2
(45) Date of Patent: May 7, 2019

(54) FLEXIBLE WIRE LED STRING LIGHTS FOR FESTIVALS, PRODUCTION METHOD THEREOF, AND APPARATUS MADE THEREFROM

(71) Applicant: Qiming Liu, Dongguna (CN)

(72) Inventor: Qiming Liu, Dongguna (CN)

(73) Assignee: Dong Guan Shi Photoelectric Technology Co., Ltd, Dongguna, Guangdong (CN)

( * ) Notice: Subject to any disclaimer, the term of this patent is extended or adjusted under 35 U.S.C. 154(b) by 225 days.

(21) Appl. No.: 15/410,796

(22) Filed: Jan. 20, 2017

(65) Prior Publication Data

US 2018/0209595 A1 Jul. 26, 2018

(51) Int. Cl.

| | |
|---|---|
| ***F21V 21/00*** | (2006.01) |
| ***F21S 4/10*** | (2016.01) |
| ***F21V 31/04*** | (2006.01) |
| *F21V 23/00* | (2015.01) |
| *F21V 23/02* | (2006.01) |
| *F21V 5/04* | (2006.01) |
| *F21V 19/00* | (2006.01) |
| *F21Y 115/10* | (2016.01) |
| *F21Y 103/10* | (2016.01) |

(52) U.S. Cl.

CPC ..... *F21S 4/10* (2016.01); *F21V 31/04* (2013.01); *F21V 5/04* (2013.01); *F21V 19/005* (2013.01); *F21V 23/001* (2013.01); *F21V 23/02* (2013.01); *F21Y 2103/10* (2016.08); *F21Y 2115/10* (2016.08)

(58) Field of Classification Search

CPC ..... F21S 4/20; F21S 4/22; F21S 4/24; F21S 4/26

See application file for complete search history.

(56) References Cited

U.S. PATENT DOCUMENTS

| | | | | |
|---|---|---|---|---|
| 7,592,276 | B2 * | 9/2009 | Hill | D02G 3/441 313/511 |
| 2005/0092517 | A1 * | 5/2005 | Fan | F21S 4/24 174/117 FF |
| 2008/0220549 | A1 * | 9/2008 | Nall | H05K 3/284 438/26 |
| 2009/0296382 | A1 * | 12/2009 | Maier | F21V 15/01 362/218 |
| 2010/0163916 | A1 * | 7/2010 | Chiang | H05K 3/284 257/99 |
| 2014/0264424 | A1 * | 9/2014 | Brooks | H01L 33/644 257/99 |

(Continued)

*Primary Examiner* — Andrew J Coughlin

(57) ABSTRACT

A flexible wire LED string lights for festivals, comprising: LED luminous flexible wire string lights, a control chip and a power supply; the LED luminous flexible wire string lights including a first conducting wire and a second conducting wire disposed axially in parallel, light welding positions provided on the corresponding position on the first and second conducting wires, a SMD LED being located between the first and second conducting wires; the light welding positions of the SMD LED, first conducting wire, and second conducting wire being wrapped by light-transmitting colloid; the flexible wire LED string lights utilizing an optical imaging structure to project the pattern of the film using an optical lens imaging principle and to illuminate to the outside through the second one-sided convex lens.

5 Claims, 3 Drawing Sheets

(56) References Cited

U.S. PATENT DOCUMENTS

2014/0369066 A1* 12/2014 Jiang ..... G02B 6/4416
362/555
2015/0362139 A1* 12/2015 Zheng ..... F21V 23/001
362/249.14
2016/0234940 A1* 8/2016 Shaytan ..... F21S 4/26

* cited by examiner

FLEXIBLE WIRE LED STRING LIGHTS FOR FESTIVALS, PRODUCTION METHOD THEREOF, AND APPARATUS MADE THEREFROM

BACKGROUND OF THE INVENTION

(1) Technical Field

The present invention relates to a festival light field, particularly to a flexible wire LED string lights for festivals.

(2) Background Art

LED string lights are a type of lights for illumination and decoration. LED string lights are actually a string of multiple LED units connected with a wire. When string lights are fixed to an object or in a place, they can have a good effect of decoration. For example, they can be used to decorate bridges, pavilion edges, parks, municipal facilities, etc. They can be applied to outdoor decoration in multiple ways. At present, the mode of direct insertion is adopted for the LED slides of LED string lights, making the volume of string lights large and uneasy to be stored and transported. There are also LED light strings that adopt SMD LEDs and put them in a flexible tube. However, such LED string lights are not soft enough, so they cannot be pressed closely according to the outline of an object or a place, which affects the appearance.

At present, LED string lights achieve the dynamic effect by means of color or ways of glittering only, and it's easy to be weary of the effect after appreciating it for some time. At present, light and shadow design is applied to indoor design for decoration. How to make LED strings light have the effect of light and shadow has been my orientation of research and development.

BRIEF SUMMARY OF THE INVENTION

For solving the above-mentioned problems, the present invention provide a flexible wire LED string lights for festivals, production method thereof, and apparatus made therefrom.

For achieving the purpose, the present invention adopts the following technical scheme A flexible wire LED string lights for festivals, comprising: LED luminous flexible wire string lights, a control chip and a power supply; the LED luminous flexible wire string lights being electrically connected to the control chip and the power supply, respectively; the control chip being connected to the power supply for controlling the luminance and flicker frequency of the LED luminous flexible wire string lights; the LED luminous flexible wire string lights including a first conducting wire and a second conducting wire disposed axially in parallel, light welding positions provided on the corresponding position on the first and second conducting wires, a surface-mount device (SMD) LED being located between the first and second conducting wires; the SMD LED having a positive terminal being welded to the light welding position of the first conducting wire, and a negative terminal being welded to the corresponding light welding position of the second conducting wire; the light welding positions of the SMD LED, first conducting wire, and second conducting wire being wrapped by light-transmitting colloid; wherein the light-transmitting colloid is a single-sided convex lens, which comprises a film disposed thereon and a second single-sided convex lens disposed on the film.

More preferably, wherein a convex surface of the single-sided convex lens and the second single-sided convex lens faces the film.

More preferably, wherein the first and second conducting wires are respectively twisted together with aramid fiber yarn, carbon fiber yarn, and nylon yarn, and respectively coated with Teflon insulating layer.

More preferably, wherein the LED luminous flexible wire string lights includes a touch switch; the touch switch is electrically connected to the control chip to control fast flickering, slow flickering, and lighting continuously of the LED luminous flexible wire string lights.

A production method for the flexible wire LED string lights for festivals according to claim 1, comprising steps as follows:

Step 1: Prepare parallel conducting wires and put the parallel conducting wires on a wire releasing wheel, a free end of the parallel conducting wires being wound around the wire releasing pendulum rod, the wire releasing pendulum rod pushing the free end of the parallel conducting wires into an inside of a wire stripping mechanism, and the parallel conducting wires being separated at an equal interval to be a first conducting wire and a second conducting wire by the wire stripping mechanism; the first and second conducting wires being exposed by a flattening and peeling mechanism to form light welding positions;

Step 2: Apply solder paste to a surface of the light welding positions by a soldering machine;

Step 3: Use a SMD LED mounting machine to connect two light pins of SMD LEDs to the light welding position of the first conducting wire and the light welding position of the second conducting wire to form string lights;

Step 4: The SMD LEDs and the light welding positions are encapsulated in a light-transmitting colloid by injection molding;

Step 5: Apply acrylic resin on a surface of the light-transmitting colloid to form a transparent resin layer with a thickness of 1 μm, irradiate with ultraviolet ray for 3 seconds to perform film hardening treatment to form a single-sided convex lens with a refractive index of 1.74, paste a film on a convex surface of the single-sided convex lens, apply acrylic resin on a surface of the film to form a transparent resin layer with a thickness of 1 μm, and irradiate with ultraviolet ray for 3 minutes to perform film hardening treatment to form a single-sided convex lens with a refractive index of 1.74.

An apparatus for making the flexible wire LED string lights for festivals according to claim 1, comprising:

a rack including sequentially from left to right, a wire releasing device, a stripping mechanism for separating the parallel conducting wires, a flattening and peeling mechanism, a soldering machine, a SMD LED mounting machine, a gluing mechanism, an ultraviolet ray irradiation mechanism, and a wire-rewinding device;

wherein the wire releasing device comprises a wire releasing wheel, a wire releasing pendulum rod and a driving motor configured to drive the rotation of the wire releasing pendulum rod; the flattening and peeling mechanism comprises a flattening and peeling end and a driving mechanism; the flattening and peeling end is moved away from or in contact with the surface of the conducting wire wound on the wire releasing pendulum rod under the action of a transmission mechanism and the driving mechanism; the wire-rewinding device comprises a wire-rewinding wheel, a wire-rewinding pendulum rod, and a driving motor configured to drive the rotation of the wire-rewinding pendulum rod.

The advantageous effect of the present invention is: the SMD LEDs are directly connected electrically to the conducting wires to form the LED string lights, so the LED rack can be removed to achieve structure simplification of the entire string lights, save costs and simplify working procedure. During the production, the wire releasing device releases the wire, and the stripping mechanism separates the parallel conducting wire at the location where the SMD LED needs to be welded, and then the flattening and peeling mechanism grinds or cuts the insulation layer of the separated conducting wires, and then flattens the conducting wires to be the light welding positions; use the SMD LED mounting machine to connect soldering tin of the SMD LED to the light welding positions of the two conducting wires; use the gluing machine to encapsulate the SMD LEDs and the light welding positions in the light-transmitting colloid by injection molding; use ultraviolet ray to harden to form an optical structure on the surface of the light-transmitting colloid; finally, wind up into a reel with the wire-rewinding device, to avoid the traditional LED lights into string lights when the need to go through secondary processing and other complex processing, in addition, the present invention is characterized by simple structure and convenience in use. Most prominently, the present invention utilizes an optical imaging structure to project the pattern of the film using an optical lens imaging principle and to illuminate to the outside through the second one-sided convex lens. The convex lens can make the image more clean and vivid to have a better effect of light and shadow. Meanwhile, the control chip can cause flicker in different colors and states as required, making the light and shadow more dynamical. The convex lens formed by applying acrylic resin can reduce the volume of the string lights greatly, and avoid the failure to form an optical imaging structure since the string lights are small.

BRIEF DESCRIPTION OF THE SEVERAL VIEWS OF THE DRAWING(S)

DETAILED DESCRIPTION OF THE INVENTION

Figure 1:
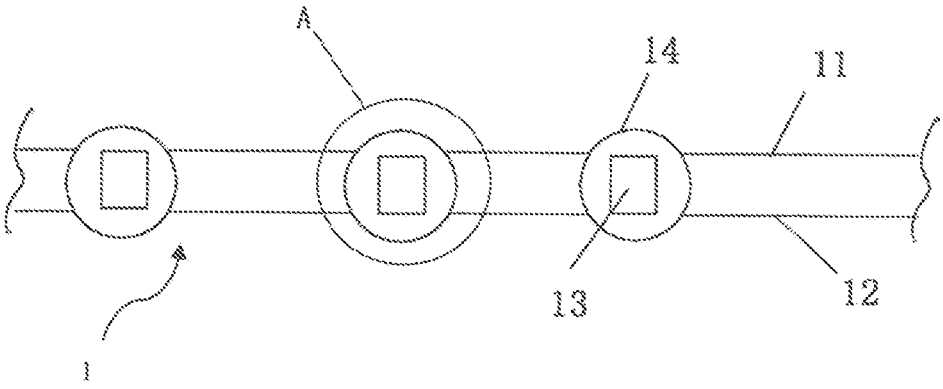
FIG. 1 is a schematic view of the present invention.
Figure 2:
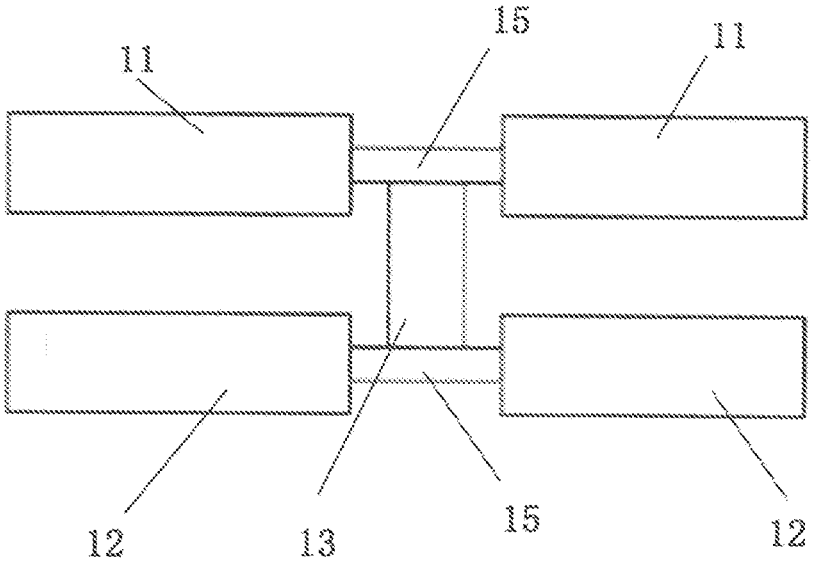
FIG. 2 is an enlarged view of part A in FIG. 1.
Figure 3:
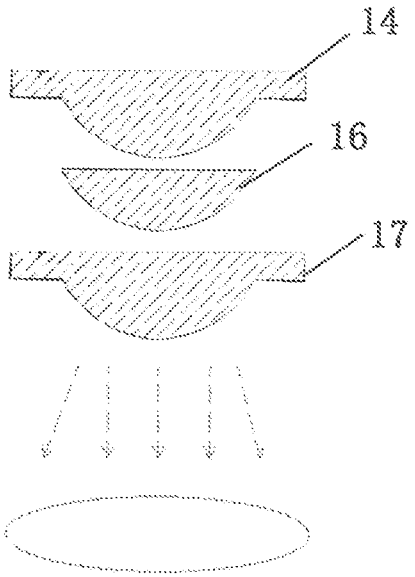
FIG. 3 is a schematic view showing the light-transmitting colloid of the present invention.
Figure 4:
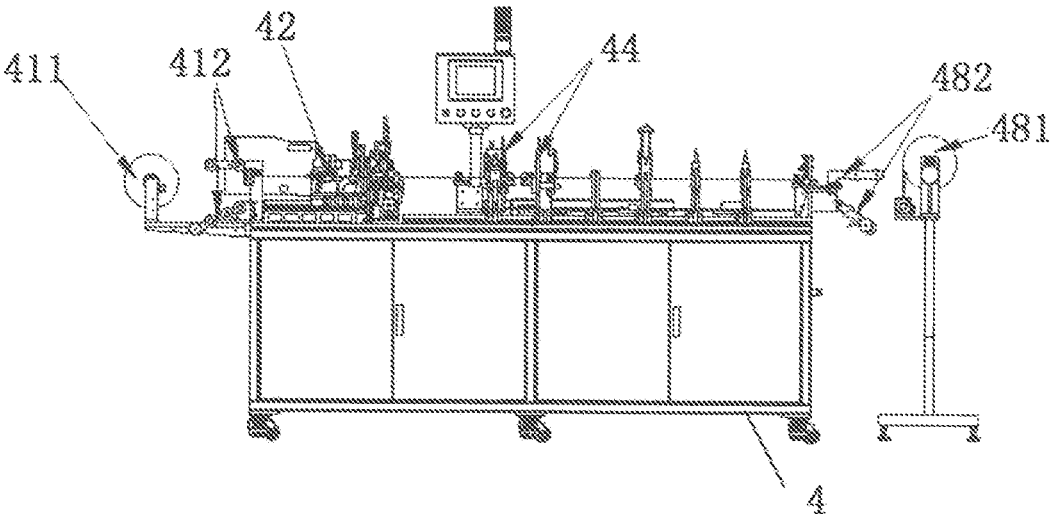
FIG. 4 is a schematic view showing the apparatus of the present invention.
Figure 5:
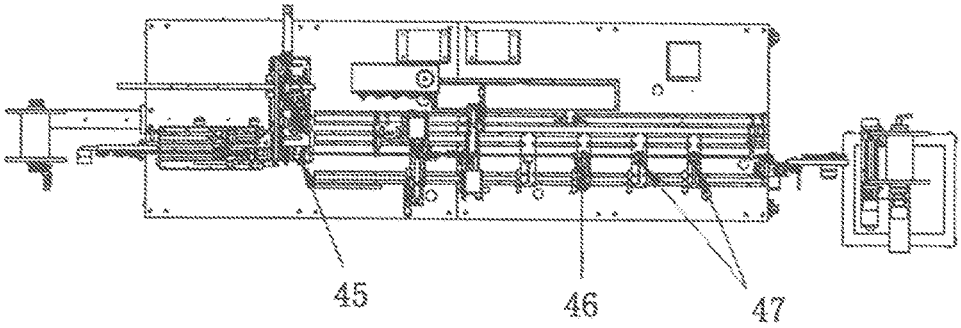
FIG. 5 is another schematic view showing the apparatus of the present invention.

Referring to FIGS. 1-5, the present invention relates to a flexible wire light emitting diode (LED) string lights for festivals, comprising LED luminous flexible wire string lights (1), a control chip and a power supply. The LED luminous flexible wire string lights are electrically connected to the control chip and the power supply, respectively. The control chip is connected to the power supply for controlling the luminance and flicker frequency of the LED luminous flexible wire string lights. The LED luminous flexible wire string lights include a first conducting wire (11) and a second conducting wire (12) disposed axially in parallel. light welding positions (15) are provided on the corresponding position on the first and second conducting wires (11, 12); a surface-mount device (SMD) LED (13) is located between the first and second conducting wires (11, 12); the SMD LED (13) having a positive terminal is welded to the light welding position (15) of the first conducting wire (11), and a negative terminal is welded to the corresponding light welding position (15) of the second conducting wire (12); the light welding positions (15) of the SMD LED (13), first conducting wire (11), and second conducting wire (12) are wrapped by light-transmitting colloid (14). Wherein the light-transmitting colloid (14) is a single-sided convex lens, which comprises a film (16) disposed thereon and a second single-sided convex lens (17) disposed on the film (16).

Characters, letters, numbers, patterns can be printed on the film (16) according to the demand of customer. The pattern can be in any form, such as, star, moon, Christmas tree, lantern and other things that have a sense of festival atmosphere. When the SMD LED (13) lights, the pattern of the film (16) is projected by the image-forming principle of optical lens, and then to the outside through the second single-sided convex lens (17), which will have a good effect of light and shallow. Meanwhile, the control chip can cause flicker in different colors and states as required, making the light and shadow more dynamical.

More preferably, the convex surface of the single-sided convex lens and the second single-sided convex lens (17) faces the film (16).

More preferably, the first and second conducting wires (11, 12) are respectively twisted together with aramid fiber yarn, carbon fiber yarn, and nylon yarn, and respectively coated with Teflon insulating layer, which solves the problem encountered in the prior art that single copper wire is easy to be broken. With the first wire and second conducting wires (11, 12) twisted together, the tensile resistance will be enhanced, so it has the characteristics of the strength and tenacity of steel, and the good electrical conductivity of copper.

What is preferred also includes a touch switch. The touch switch is connected with the control chip to control the working state of the LED luminous flexible wire string lights—fast flickering, slow flickering, and lighting continuously.

A production method for the flexible wire LED string lights for festivals comprises steps as follows:

Step 1: Prepare parallel conducting wires and put the parallel conducting wires on a wire releasing wheel (411). A free end of the parallel conducting wires is wound around the wire releasing pendulum rod (412), the wire releasing pendulum rod (412) pushes the free end of the parallel conducting wires into the inside of a wire stripping mechanism (42). The parallel conducting wires are separated at an equal interval to be a first conducting wire (11) and a second conducting wire (12) by the wire stripping mechanism. The first and second conducting wires (11, 12) are exposed by a flattening and peeling mechanism (43) to form light welding positions (15).

Step 2: Apply solder paste to a surface of the light welding positions (15) by a soldering machine (44).

Step 3: Use a SMD LED mounting machine (45) to connect two light pins of SMD LEDs to the light welding position (15) of the first conducting wire (11) and the light welding position (15) of the second conducting wire (12) to form string lights.

Step 4: The SMD LEDs and the light welding positions (15) are encapsulated in a light-transmitting colloid (13) by injection molding.

Step 5: Apply acrylic resin on a surface of the light-transmitting colloid (13) to form a transparent resin layer with a thickness of 1 μm, irradiate with ultraviolet ray for 3 seconds to perform film hardening treatment to form a single-sided convex lens with a refractive index of 1.74, paste a film on a convex surface of the single-sided convex lens, apply acrylic resin on a surface of the film to form a transparent resin layer with a thickness of 1 μm, and irradiate with ultraviolet ray for 3 minutes to perform film hardening treatment to form a single-sided convex lens with a refractive index of 1.74.

An apparatus for making flexible wire LED string lights for festivals, comprising a rack (4), the rack (4) including sequentially from left to right, a wire releasing device, a stripping mechanism (42) for separating the parallel conducting wires, a flattening and peeling mechanism (43), a soldering machine (44), a SMD LED mounting machine (45), a gluing mechanism (46), an ultraviolet ray irradiation mechanism (47), and a wire-rewinding device. The wire releasing device comprises a wire releasing wheel (411), a wire releasing pendulum rod (412) and a driving motor configured to drive the rotation of the wire releasing pendulum rod (412). The flattening and peeling mechanism (43) comprises a flattening and peeling end and a driving mechanism; the flattening and peeling end is moved away from or in contact with the surface of the conducting the wire wound on the wire releasing pendulum rod (412) under the action of a transmission mechanism and the driving mechanism. The wire-rewinding device comprises a wire-rewinding wheel (481), a wire-rewinding pendulum rod (482), and a driving motor configured to drive the rotation of the wire-rewinding pendulum rod (482).

The advantageous effect of the present invention is: the SMD LEDs are directly connected electrically to the conducting wires to form the LED string lights, so the LED rack can be removed to achieve structure simplification of the entire string lights, save costs and simplify working procedure. During the production, the wire releasing device releases the wire, and the stripping mechanism (42) separates the parallel conducting wire at the location where the SMD LED needs to be welded, and then the flattening and peeling mechanism (43) grinds or cuts the insulation layer of the separated conducting wires, and then flattens the conducting wires to be the light welding positions (15); use the SMD LED mounting machine (45) to connect soldering tin of the SMD LED to the light welding positions (15) of the two conducting wires; use the gluing machine to encapsulate the SMD LEDs and the light welding positions (15) in the light-transmitting colloid (13) by injection molding; use ultraviolet ray to harden to form an optical structure on the surface of the light-transmitting colloid (13); finally, wind up into a reel with the wire-rewinding device, to avoid the traditional LED lights into string lights when the need to go through secondary processing and other complex processing, in addition, the present invention is characterized by simple structure and convenience in use. Most prominently, the present invention utilizes an optical imaging structure to project the pattern of the film using an optical lens imaging principle and to illuminate to the outside through the second one-sided convex lens (17). The convex lens can make the image more clean and vivid to have a better effect of light and shadow. Meanwhile, the control chip can cause flicker in different colors and states as required, making the light and shadow more dynamical. The convex lens formed by applying acrylic resin can reduce the volume of the string lights greatly, and avoid the failure to form an optical imaging structure since the string lights are small.

The above only describes some exemplary embodiments of the present invention. Those having ordinary skills in the art may also make many modifications and improvements without departing from the conception of the invention, which shall all fall within the protection scope of the invention.

I claim:

1. A flexible wire LED string lights for festivals, comprising:

LED luminous flexible wire string lights (1), a control chip and a power supply;

the LED luminous flexible wire string lights being electrically connected to the control chip and the power supply, respectively; the control chip being connected to the power supply for controlling the luminance and flicker frequency of the LED luminous flexible wire string lights (1);

the LED luminous flexible wire string lights including a first conducting wire (11) and a second conducting wire (12) disposed axially in parallel, light welding positions (15) provided on the corresponding position on the first and second conducting wires (11, 12), a surface-mount device (SMD) LED (13) being located between the first and second conducting wires (11, 12); the SMD LED (13) having a positive terminal being welded to the light welding position (15) of the first conducting wire (11), and a negative terminal being welded to the corresponding light welding position (15) of the second conducting wire (12); the light welding positions (15) of the SMD LED (13), first conducting wire (11), and second conducting wire (12) being wrapped by light-transmitting colloid (14); wherein the light-transmitting colloid (14) is a single-sided convex lens, which comprises a film (16) disposed thereon and a second single-sided convex lens (17) disposed on the film (16);

wherein the first and second conducting wires (11, 12) are respectively twisted together with aramid fiber yarn, carbon fiber yarn, and nylon yarn, and respectively coated with Teflon insulating layer.

2. The flexible wire LED string lights according to claim 1, wherein a convex surface of the single-sided convex lens and the second single-sided convex lens (17) faces the film (16).

3. The flexible wire LED string lights according to claim 1, wherein the LED luminous flexible wire string lights (1) includes a touch switch; the touch switch is electrically connected to the control chip to control fast flickering, slow flickering, and lighting continuously of the LED luminous flexible wire string lights (1).

4. A production method for the flexible wire LED string lights for festivals according to claim 1, comprising steps as follows:

Step 1: Prepare parallel conducting wires and put the parallel conducting wires on a wire releasing wheel (411), a free end of the parallel conducting wires being wound around the wire releasing pendulum rod (412), the wire releasing pendulum rod (412) pushing the free end of the parallel conducting wires into an inside of a wire stripping mechanism (42), and the parallel conducting wires being separated at an equal interval to be a first conducting wire (11) and a second conducting wire (12) by the wire stripping mechanism; the first and second conducting wires (11, 12) being exposed by a flattening and peeling mechanism (43) to form light welding positions (15);

Step 2: Apply solder paste to a surface of the light welding positions (15) by a soldering machine (44);

Step 3: Use a SMD LED mounting machine (45) to connect two light pins of SMD LEDs to the light welding position (15) of the first conducting wire (11) and the light welding position (15) of the second conducting wire (12) to form string lights;

Step 4: The SMD LEDs and the light welding positions (15) are encapsulated in a light-transmitting colloid (13) by injection molding;

Step 5: Apply acrylic resin on a surface of the light-transmitting colloid (13) to form a transparent resin layer with a thickness of 1 μm, irradiate with ultraviolet ray for 3 seconds to perform film hardening treatment to form a single-sided convex lens with a refractive index of 1.74, paste a film on a convex surface of the single-sided convex lens, apply acrylic resin on a surface of the film to form a transparent resin layer with a thickness of 1 μm, and irradiate with ultraviolet ray for 3 minutes to perform film hardening treatment to form a single-sided convex lens with a refractive index of 1.74.

5. An apparatus for making the flexible wire LED string lights for festivals according to claim 1, comprising:

a rack (4) including sequentially from left to right, a wire releasing device, a stripping mechanism (42) for separating the parallel conducting wires, a flattening and peeling mechanism (43), a soldering machine (44), a SMD LED mounting machine (45), a gluing mechanism (46), an ultraviolet ray irradiation mechanism (47), and a wire-rewinding device;

wherein the wire releasing device comprises a wire releasing wheel (411), a wire releasing pendulum rod (412) and a driving motor configured to drive the rotation of the wire releasing pendulum rod (412); the flattening and peeling mechanism (43) comprises a flattening and peeling end and a driving mechanism; the flattening and peeling end is moved away from or in contact with the surface of the conducting wire wound on the wire releasing pendulum rod (412) under the action of a transmission mechanism and the driving mechanism; the wire-rewinding device comprises a wire-rewinding wheel (481); a wire-rewinding pendulum rod (482), and a driving motor configured to drive the rotation of the wire-rewinding pendulum rod (482).

* * * * *